United States Patent [19]

Matsuda

[11] 4,034,492

[45] July 12, 1977

[54] FOREIGN EXCHANGE READY RECKONING CHART

[76] Inventor: Akira Matsuda, No. 7-C22-307, Shinsnri-Higashi, Toyonaka, Osaka, Japan

[21] Appl. No.: 645,294

[22] Filed: Dec. 29, 1975

[30] Foreign Application Priority Data

Jan. 13, 1975 Japan ..... 50-6603
Nov. 21, 1975 Japan ..... 50-158720[U]

[51] Int. Cl.[2] ..... G09F 11/04
[52] U.S. Cl. ..... 40/70 R
[58] Field of Search ..... 40/70 R, 63; 35/24

[56] References Cited

U.S. PATENT DOCUMENTS

| | | | |
|---|---|---|---|
| 916,564 | 3/1909 | Kristofek | 40/70 R |
| 2,631,391 | 3/1953 | Hanna | 40/70 R X |
| 3,365,818 | 1/1968 | Greiner | 40/70 R X |
| 3,432,942 | 3/1969 | Jack | 40/70 R X |
| 3,760,165 | 9/1973 | Marcks | 235/89 R |
| 3,914,889 | 10/1975 | Wagner | 40/63 R X |

*Primary Examiner*—Hugh R. Chamblee
*Assistant Examiner*—Wenceslao J. Contreras
*Attorney, Agent, or Firm*—Wenderoth, Lind and Ponack

[57] ABSTRACT

A foreign exchange ready reckoning chart in which an indicator plate and a graduation plate are put together one over the other by means of an eyelet so as to rotate mutually and said indicator plate has windows cut open in sectoral form around said eyelet as a center to correspond respectively to the alternate step of circular graduations, the position of said windows at the upper half of the indicator plate being one step shifted from that of the windows at the lower half of the plate, and said graduation plate has graduations arranged in concentric circles around said eyelet as their center, the graduated figures being alternately in normal standing style and inverted standing style in every other circular step of graduations.

7 Claims, 21 Drawing Figures

FOREIGN EXCHANGE READY RECKONING CHART

The present invention relates to a foreign exchange ready reckoning chart which is capable of instantly finding out wanted exchange values of different foreign currencies.

Generally, exchange values of foreign currencies are calculated according to current exchange rates which are subject to daily fluctuation. However, apart from any big sum of money and so far as it is concerned with the calculations for ordinary people, calculations can be made by means of standard exchange rates without causing many errors in calculation.

In this connection, various kinds of foreign exchange reckoning chart have hitherto been in use but all of them have disadvantages in that the can calculate only for a few number of countries and are of large size in construction.

The present invention aims at providing a foreign exchange ready reckoning chart of small and handy form yet capable of calculating for increased number of different foreign currencies with their respective values minutely divided in the graduations of the chart thus improving said disadvantages of conventional charts.

The other objects and features of the present invention will be made clear as it is disclosed in detail hereunder with reference to the accompanying drawings in which:

FIGS. 15, 16, 17 and 18 show the fourth example of an embodiment of the invention of which FIG. 15 is oblique view, FIG. 16 an unfolded indicator plate and FIGS. 17, 18 are the plans of the examples of the indicator plate;

Figure 1:
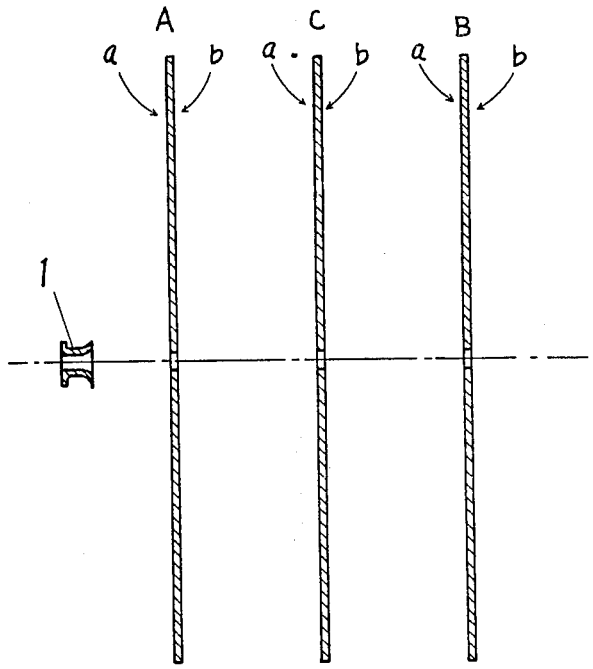
FIG. 1 is a side sectional view to explain the chart according to the present invention.

As shown by FIG. 1, the chart of the present invention is, in its basic construction, consists of indicator plates A, B and a graduation plate C, each being made of card-board or plastics, etc. of which two plates at least are put together one over the other by means of an eyelet, for instance, so as to be able to rotate mutually. With a chart consisting of an indicator plate A and a graduation plate B, the face *a* of plate B has a basic currency (for instance, Japanese Yen wanted to be exchanged into U.S. Dollar) and corresponding foreign currency (Dollar in this case) respectively graduated in parallel around the center of the circle and the face *a* of plate A has an indicating line to indicate said basic currency connected with the corresponding foreign currency with said indicating line falling visible on the face *a* of plate B when seen from the face *a* of plate A. The chart of this invention is so constructed that its user, after setting said indicating line on one of the graduated figures of the basic currency by rotating plates A, B relatively, will reckon his wanted exchange value easily and clearly just by looking at the position of the corresponding foreign currency.

In addition to the abovementioned basic construction, the chart of this invention can be constructed so as to cover foreign exchanges between many number of different countries wthout making it large in size and complicated in construction and also to have the graduated figures appear always in a normal upright standing style instead of an inverted standing style.

Figure 2:
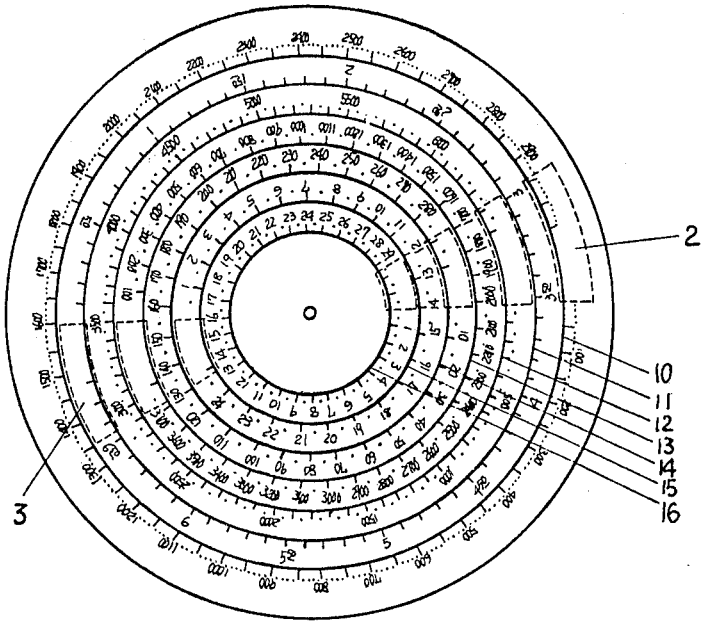
FIGS. 2, 3, 4 and 5 show the examples of the graduation to be used in the present invention.

FIGS. 2–5 show the styles of graduation for use in the present invention, various values of different foreign currencies being graduated in concentric circles around the jointing eyelet of the plates. FIG. 2 shows graduated values of different currencies in their respective unit of which 10 is Japan, 11 Australia, 12 Italy, 13 Korea, 14 Greece, 15 Singapore and 16 Switzerland, each graduated figure being, of course, spaced at an interval which is so determined as to have the exchange values by the current normal exchange rates corresponding with each other.

Figure 3:
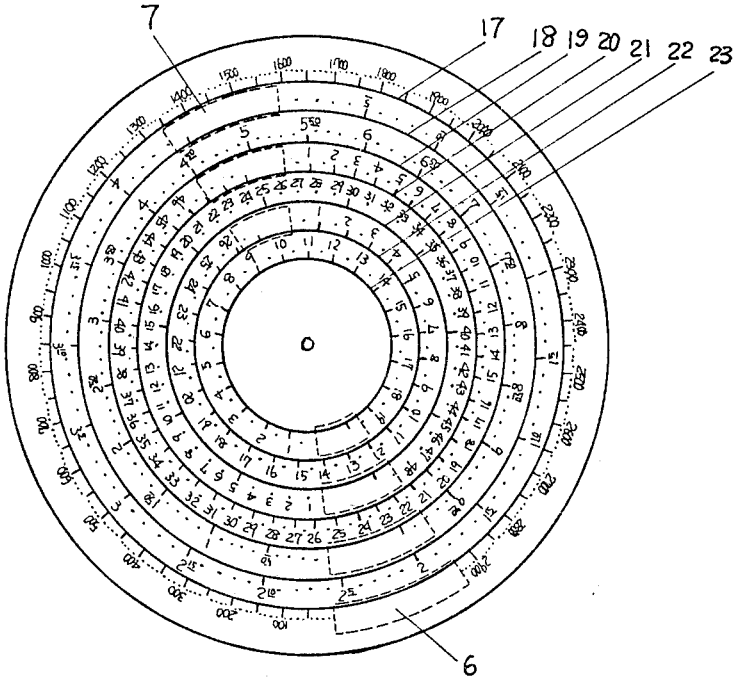
Figure 4:
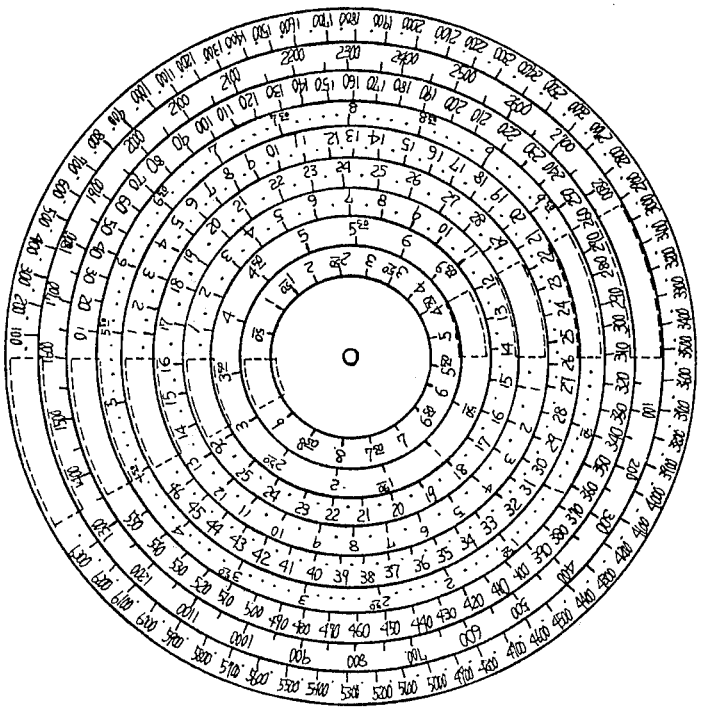
Figure 5:
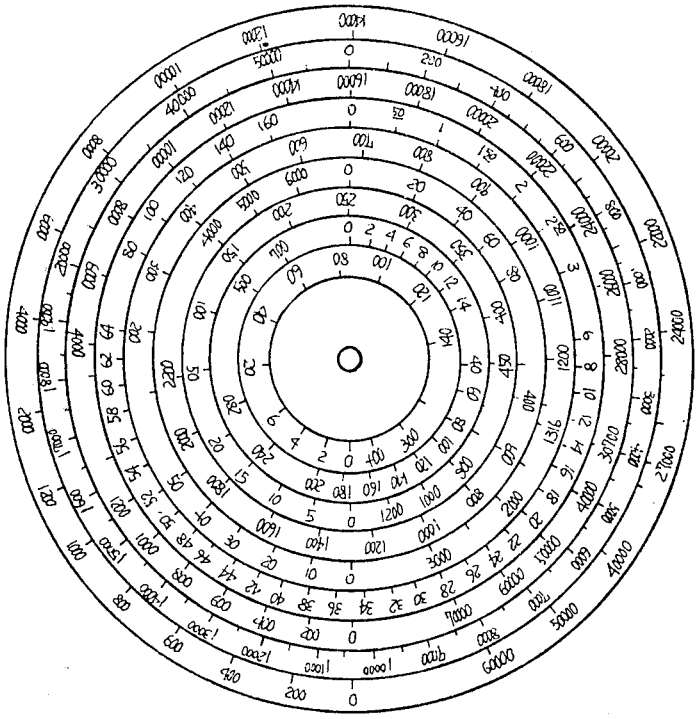

Assuming $y$ = exchanged value, $x$ = basic value (value of the basic currency wanted to be exchanged) and $\alpha$ = exchange rate between these two countries, it can well be expressed as $y = \alpha x$. Therefore, the interval of graduation can be determined by taking one unit of $y$ as $1/\alpha$ of $x$, that is to say, in this example of embodiment, it is all right to arrange the graduation taking the angle of 1 unit of $y$ as an angle of $1/\alpha$ of $x$ because the graduation is arranged in circular form. FIG. 3 shows values of different currencies graduated by their respective unit of which 17 is Japan, 18 U.K., 19 U.S.A., 20 France, 21 Hong Kong, 22 West Germany and 23 China, all being arranged likewise in the case of FIG. 2. In FIG. 4, values of different currencies are graduated in concentric circles in the order of Italy, Japan, Spain, U.S.A., France, Switzerland, West Germany, USSR, U.K., starting from the outer circle. FIG. 5 is different from FIGS. 2–5 and shows values of different currencies graduated not at an equal interval but on a logarithmic scale in the order of Japan, U.S.A., Taiwan, Hong Kong, Singapore, Philippine, Thailand, Korea and Indonesia starting from the outer circle.

It should be noted that, as shown in FIGS. 2–5, the graduated figures are indicated alternately in normal upright standing style and inverted standing style in every other cocentric circle from outside to inside. Consequently, the relations of the figures of normal upright standing style with those of inverted standing style become reversed when the circle is rotated at 180° moving each figure from a certain point to its opposite point. Additionally, it is apparent that the number of graduations 10–16 can be increased or decreased as desired in order to set them forth in a necessary number. Further, as each graduation is arranged in circular form, the graduation near the circumference of a circle of about 10 cm. diameter can be divided into more than 300 at an interval of 1 mm. with a result of easy reading of figures and the minimum area utilized to the maximum efficiency.

Figure 6:
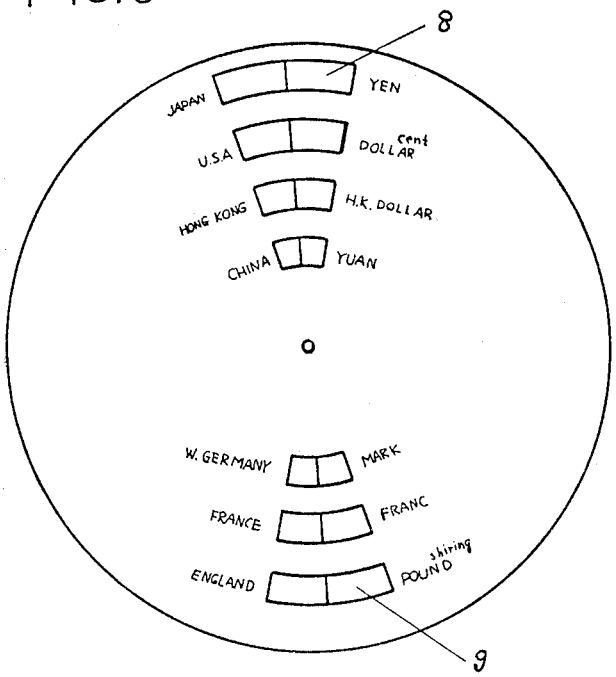
FIGS. 6 and 7 show the examples of the indicator plate of the chart of this invention.
Figure 7:
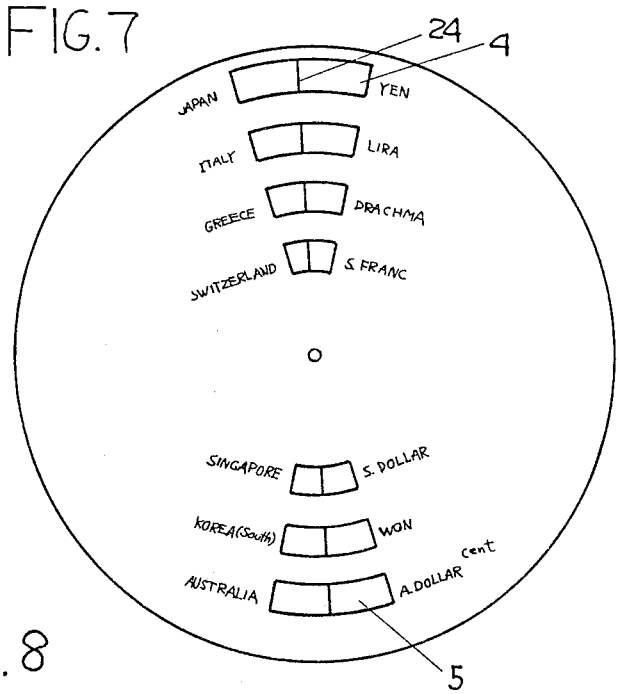

FIGS. 6 and 7 are plans showing the appearance of face *a* of plate A and face *b* of plate B, these faces being respectively capable of taking either appearance shown by FIGS. 6 and 7. FIG. 7 shows an indicator plate that corresponds to the graduation of FIG. 2 having the same circumference as plate A or B and also has windows 4, 5 which correspond to the sectoral portions 2, 3 indicated by dot-dash lines of FIG. 2. Said windows 4, 5 are so cut that each respective window corresponds alternately to the graduated figures of every other cocentric circle enclosed by sectoral partitions formed in about 30° direction from the center towards the circumference. Therefore, said windows 4, 5 are provided in four at the upper half of the plate and in three at the lower half each corresponding to the dot-dash lined portions 2 and 3 of FIG. 2. At the sides of windows 4, 5, names of the different countries and their currency units are indicated to correspond to their respective graduations. Windows 4, 5 also have an indicating line or arrows 24 along on the perpendicular passing through the center of the plate.

FIG. 6 shows an indicator plate that corresponds to the graduations of FIG. 3 and is of same construction as FIG. 7, its windows 8, 9 being cut so as to correspond to the dot-dash lined portions 6, 7 of FIG. 3.

Figure 8:
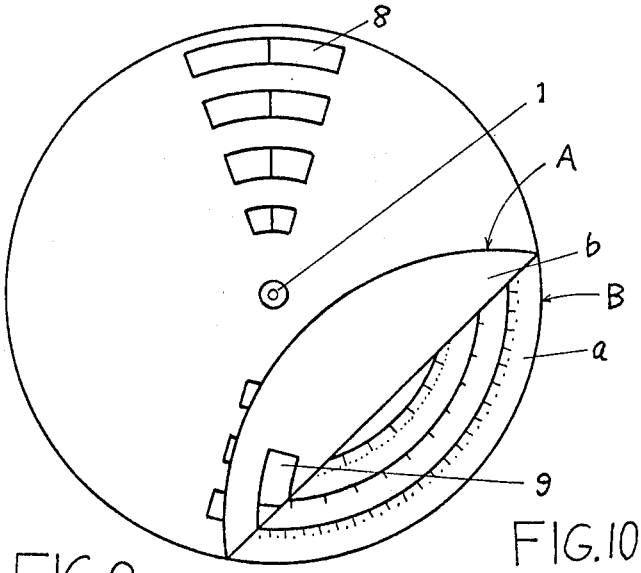
FIGS. 8, 9 and 10 are the plans of the first examples of an embodiment of the invention, FIG. 8 showing its indicator plate partly turned up.
Figure 9:
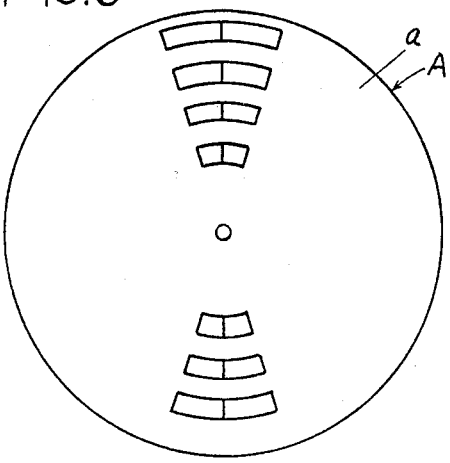
Figure 10:
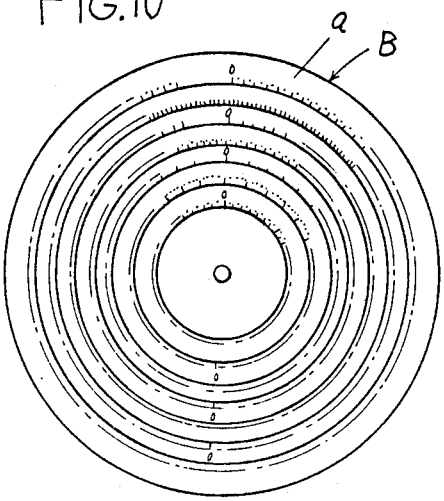

FIG. 8 shows the first embodiment of this invention, namely a foreign exchange reckoning chart one side of which only is to be used. This chart consists of a plate A of FIG. 9 as an indicator plate and a plate B as a graduation plate, both of them being put together by means of an eyelet so as to rotate mutually with the face *b* of plate A against the face *a* of plate B. Here, face *a* of plate A is of the same construction as that of FIG. 6 and face *b* of plate B has graduations similar to those of FIG. 3. When plate B is rotated, the graduated values will appear in windows 8, 9 only in an area of dot-dash lined portions of FIG. 3 but the values allowed to appear in the upper windows 8 are different from those allowed to appear in the lower windows 9 in circular step of graduations 10–16. The number of values visible through windows 8, 9 is 7 in total lined up in the direction of the diameter of the circles, namely 4 in the upper half and 3 in the lower half of the plate. All the figures appear in normal upright standing style because of the aforesaid method of arranging the graduations alternately in normal standing style and inverted standing style in every other cocentric circle. In this embodiment of the invention, different currency values can be graduated in minute division of total degree of 360° of the disc plate. The figures to be read through windows 8, 9 are all in normal upright standing style, figures in inverted standing style being hidden by the face *a* of plate A. Therefore, users can obtain their wanted values clearly and instantly without taking the extra trouble of turning over the chart to use it. From the construction of the above-disclosed embodiment of the invention, it is apparently possible to form face *a* of plate A in the style of FIG. 6 and face *a* of plate B in the style of FIG. 3 or to make other similar arrangements as desired.

Figure 11:
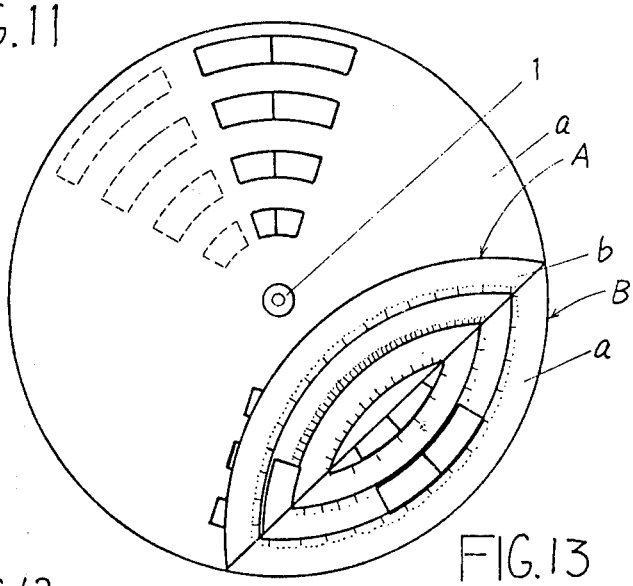
FIGS. 11, 12 and 13 are the plans of the second example of embodiment of the invention, FIG. 11 showing its indicator plate partly turned up.
Figure 12:
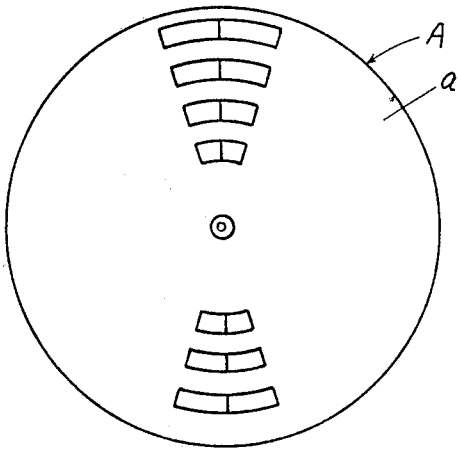
Figure 13:
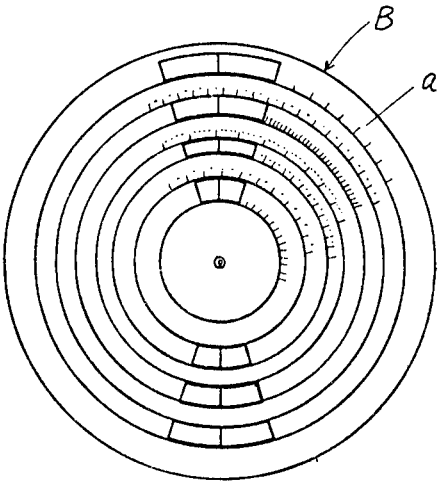

FIG. 11 shows the second embodiment of the invention in which both sides of each plate A, B are to be used. This chart consists of two disc plates A,B put together one over the other by means of an eyelet so as to rotate mutually with face *b* of plate A against face *a* of plate B. Plate A is same as FIG. 7 in its outer style and has the same graduation as that of FIG. 3 on its inside face while plate B is same as FIG. 6 in its outer style and has same graduation as that of FIG. 2 on its inside face. Therefore, each plate A, B serves the double functions of being both an indicator plate and graduation plate; in other words, in this case, the forms of FIGS. 2 and 6 and the forms of FIGS. 3 and 7 are respectively united into one. Consequently, the dot-dash lined portions 2, 3 and 6, 7 of FIGS. 2, 3 are cut off as windows 4, 5 and 8, 9 so that the graduations will naturally be lacking in the figures of said portions. This embodiment is quite the same as the first example in its arrangement of windows and graduations and all of the graduations appear in the windows with their figures in normal upright standing style. Although this second embodiment is the same as the first embodiment in construction, foreign currencies exchangeable thereby amount actually to those of 14 different countries, this being twice as much of the first embodiment. However, at each half a round relative of plate A and plate B, windows 4, 5 and windows 8, 9 will overlap with each other producing unobstructed openings through the two plates, and the graduations will be lacking in such portions, but these lacking portions being in an angle of about 30° of each graduation, the influence to be caused thereby on the entire graduations is very little.

When all the graduations are divided at an equal intervals respectively in the plates A, B, that is to say, when the respective graduation of these two plates are arranged to correspond with each other in their exchange values by the current normal exchange rates, a certain value of a certain foreign currency (U.S. Dollar 3.50 for instance) set forth on one side of the chart can be reckoned in a foreign currency (S.Fr. 10.50 of Switzerland for instance) on the other side of the chart.

Figure 14:
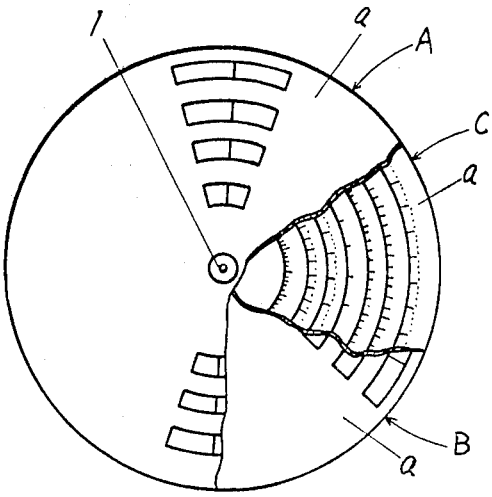
FIG. 14 is the plan of the third example of embodiment of the invention showing its indicator plate partly broken.

FIG. 14 shows the fourth embodiment of the invention in which the chart consists of three plates A, B, C as shown by FIG. 1 all put together one over the other by means of an eyelet so as to rotate mutually, both side of the chart being for use. Face *a* of plate A and face *b* of plate B are respectively styled like FIGS. 7, 6 and the intermediate plate C has graduations like FIG. 2 on its face *a* and those of FIG. 3 on its other face *b*. Face *b* of plate A and face *a* of plate B remain as meaningless white paper in this case. Consequently, having the plates A, B as indicator plates and plate C as the graduation plate, this chart can be used on its both sides in the same way as in the first embodiment. Its entire circle can be utilized without lacking in the dot-dash lined portions of graduation shown by FIGS. 2, 3 and exchangeable foreign currencies cover as much as 14 different countries. This embodiment can be said to be the first embodiment added with an advantage of using its both sides. When compared with the second embodiment, the chart of this embodiment has such a advantages that if it becomes necessary to amend the values of its graduations, owing to some big changes in foreign currencies, it can cope with such situations simply by replacing its plate C which is removable and its graduations are not broken by lacking of figures therein even when windows 4, 5 overlap windows 6, 7.

Figure 15:
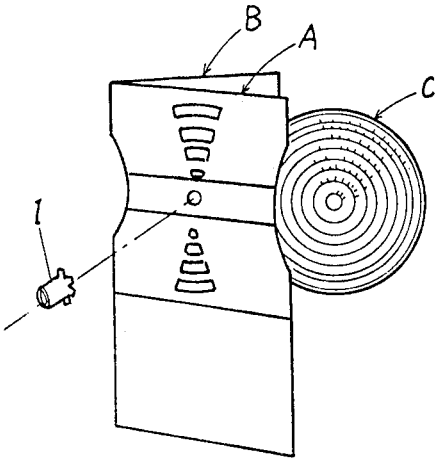
Figure 16:
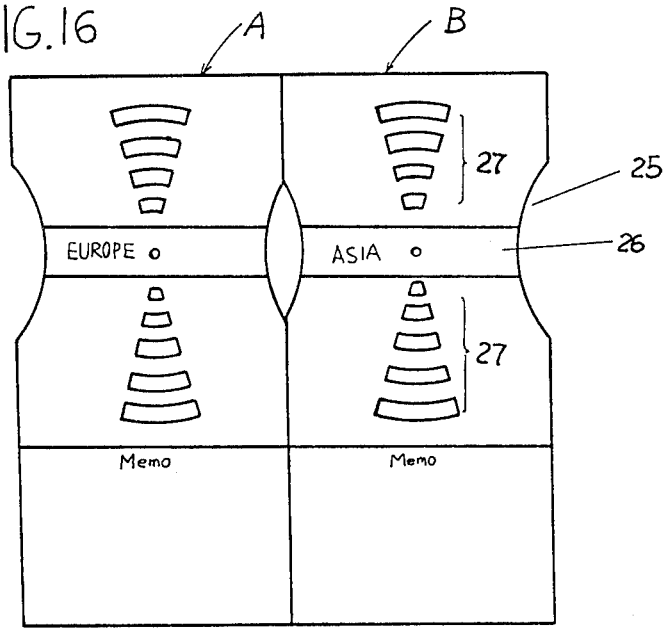
Figure 17:
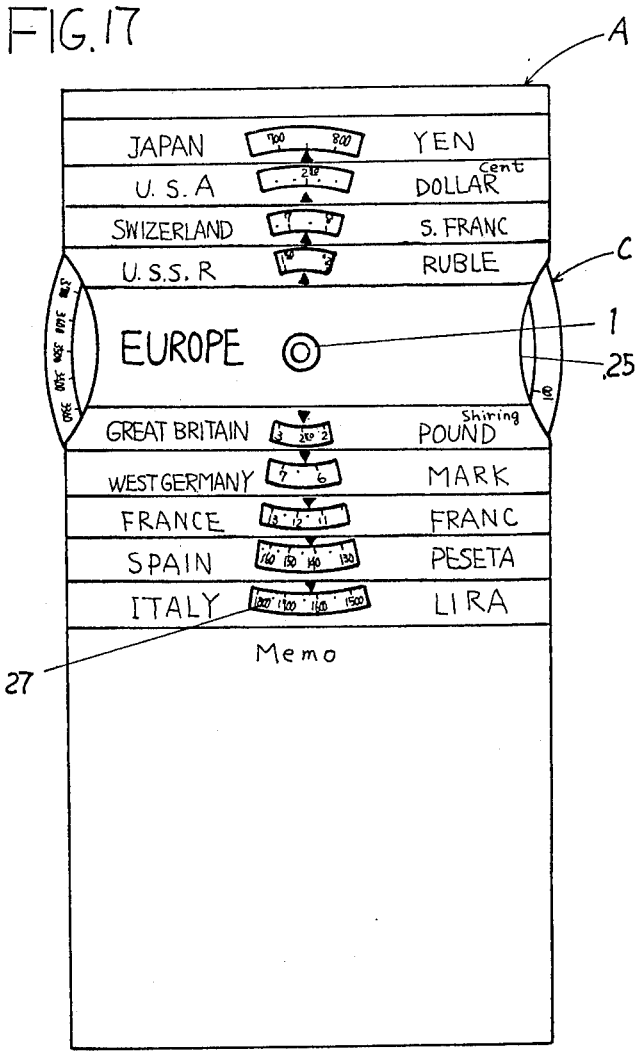
Figure 18:
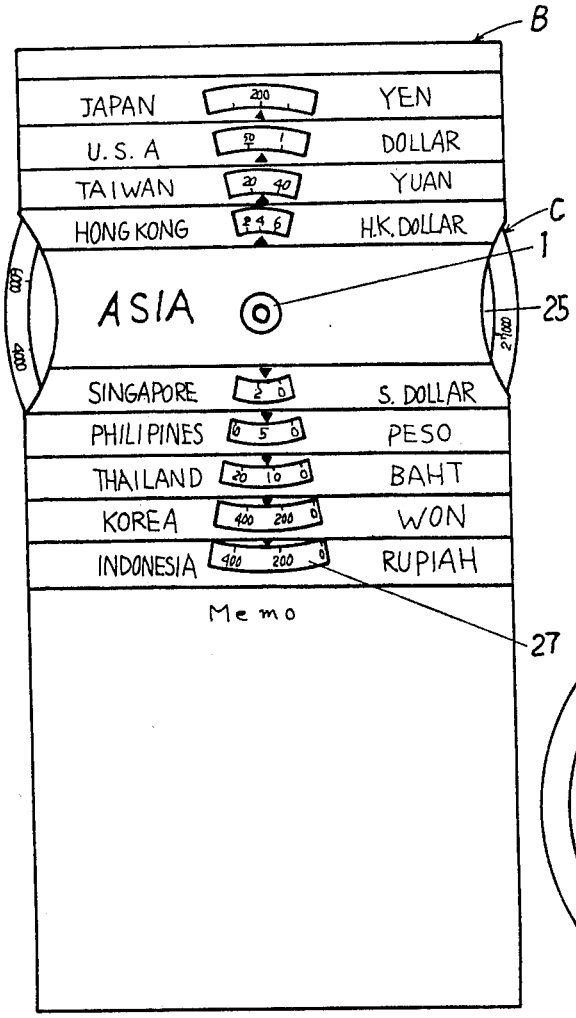

FIGS. 15–18 show the fourth embodiment of the invention having plates A, B different in style from those of the third embodiment. As shown by FIG. 15, plate A,B is folded in the style of folio and have a plate C as a rotary disc plate put together between the folding by means of an eyelet, said plate C having respective graduations as in FIGS. 4, 5 on both sides. When unfolded, plate A,B is a square cardboard as shown by FIG. 16 which is folded at its center line. As plates A,B are quite the same as each other, descriptions are given here only of plate A. The upper half of plate A windows 27 cut respectively in the shape of a sector formed by the circumferential lines of the concentric circles around the eyelet hole 26 as their center, as well as by the two lines intersecting at said center at a degree of 30L The windows above the eyelet hole or the center are cut respectively in the positions each shifted by one concentric circle from the positions of the windows below the center hole, all the windows agreeing to the graduations of plate C in their width and position. A small part of each edge of plate A,B is cut off in an arc for easy rotation of the disc plate C (when plate A,B is unfolded, the cut off part in the center presents an opening in a shape of section of a lens). Each outside face of plate A,B is styled as shown by FIGS. 17, 18 and at the sides of the windows thereof, names of different countries and their currency units are indicated to correspond to the graduations visible through the respective windows. In this case, each window 27 allows the appearance of values of different steps of the circular graduations alternately, and the graduations visible in the upper windows do not appear in the lower windows; that is to say, that the graduations of the circular steps of even number counted from the center of circle will appear in the upper windows and those of the steps of odd number in the lower windows. Additionally, since each graduation is arranged in circular form, the figures thereof will be reversed in their standing style when they come round from the upper half of plate A,B to the lower half. The graduated figures on plate C are different in their standing style alternately according to their position in the concentric circles, namely normal upright standing in the steps of even number and inverted standing in the steps of odd number counted from the center of circle. Consequently, all the figures always appear in all windows in normal upright standing style. Although this fourth embodiment is the same as the third embodiment in construction, it has an advantage of easiness of handling.

Figure 19:
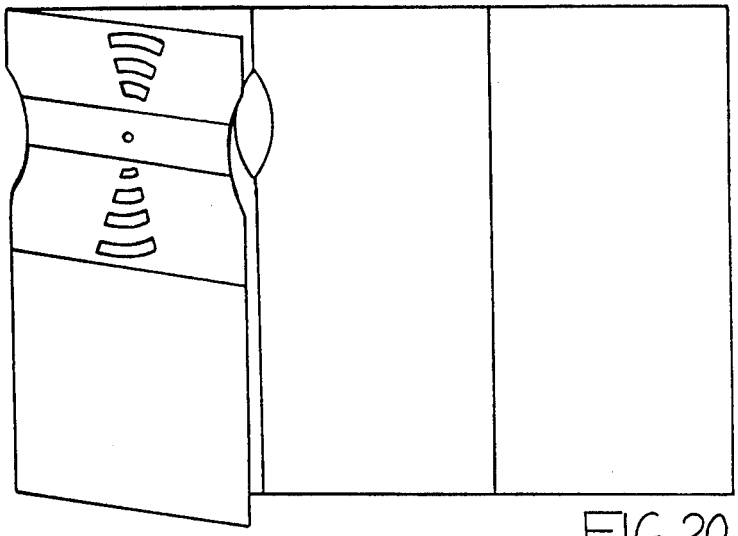
FIGS. 19 and 20 show another example of an embodiment of the invention.

FIG. 19 shows the fifth embodiment which is same with the fourth in construction but different in style. Its indicator plate with its extension (of two plates in this case) to be folded into four has a capacity of being somewhat of pamphlet capable of carrying thereon various descriptions of memorandums useful for users or some kind of advertisement, etc.

Figure 20:
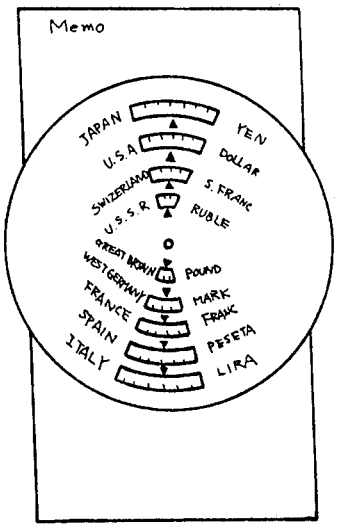

FIG. 20 shows the sixth embodiment of the invention in which plates A, B are disc plates and plate C is a rectangular plate. The form of plates A, B may be circle, rectangle, triangle or any other form as desired.

Figure 21:
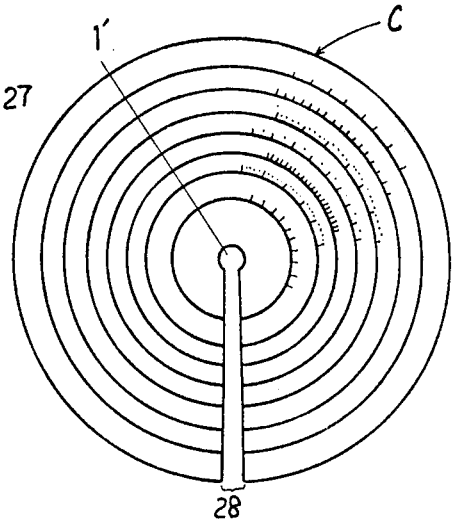
FIG. 21 shows a graduation plate of removable type of the chart of the present invention.

FIG. 21 shos the plate C to be used in the seventh embodiment of the invention which is same with the third in construction, but its plate C, as shown by FIG. 21, is made removable by providing therein a cut-off 28 shaped in the narrow sector expanding in width outwards from the center 1 of the circle. By means of the cut-off provided as above, plate C can be freely inserted into and removed from the chart. With this chart of the seventh example, it is possible to readily deal with any changes in exchange rates or optional needs for other foreign exchanges, etc. by replacing plate C with a new one having graduations to meet such changes. Therefore, it is not required to abandon the entire chart in use and it is also possible to reckon exchange values of many additional foreign currencies by a single chart of this example without using any additional chart.

Other ways of utilizing of the present invention, such as calculation of foreign exchange on one side of the chart and reckoning of difference of time of the world on the other wide, etc. come into consideration for instance.

As aforedescribed, in the foreign exchange reckoning chart according to the present invention, graduations of exchange values are arranged in circular form with their figures alternately in the style of normal standing and inverted standing in every other cocentric circle, and windows are cut so as to allow the appearance therein of the figures of each graduation always in the normal upright standing style with a result of easy and clear reckoning of exchange values without any complications. The chart of this invention, despite of its limited area, can take in so many number of foreign currencies of different countries that it provides a small sized chart of this kind quite handy yet of large benefit for traders and travellers, etc. Further, in case of the fourth through sixth embodiments of the invention, the chart has sufficient space available around its windows for putting thereon various descriptions or memos useful for users or some kind of advertisement, etc. thus serving as a kind of pamphlet for public relations.

What is claimed is:

1. A foreign currency exchange device for determining the conversions between currencies of various countries, said device comprising:

a circular graduation plate having currency graduations thereon corresponding to the exchange ratios between currencies of various countries, said graduations radiating in concentric circles from the center of said plate and alternating between first normal upright standing graduations and second inverted graduations in every other concentric circle of graduations;

first indicator plate means over said circular graduation plate for aligning and comparing said graduations therethrough, said indicator plate means having first sectoral cut-out window portions therethrough corresponding to said first alternating concentric graduations on said graduation plate when said first graduations are upright and second sectoral cut-out window portions therethrough corresponding to said second alternating concentric graduations on said graduation plate when said second graduations are upright, whereby said first normal upright standing graduations appear in an upright position through said first cut-outs and said second inverted graduations appear in an upright position through said second cut-out window portions; and eyelet means through said indicator plate means and said circular graduation plate for rotatably mounting said graduation plate and said indicator plates together.

2. A currency exchange device as claimed in claim 1 wherein:

said graduation plate has graduations corresponding to the exchange ratios between currencies of various countries graduated on both sides thereof in concentric circles radiating from the center of each side of said plate, said concentric graduations alternating between first normal upright stand graduations and second inverted graduations in every other circle of graduations on both sides of said plate;

said indicator plate means is fitted over both sides of said graduation plate and has first central cut-out window portions therethrough corresponding to said first alternating concentric graduations on both sides of said graduation plate and second sectoral cut-out window portions therethrough corresponding to said second alternating concentric graduations on both sides of said graduation plate.

3. A currency exchange device as claimed in claim 2 wherein said graduation plate is removable from said indicator plate means.

4. A currency exchange device as claimed in claim 1 wherein:

said indicator plate means further has, on the side thereof adjacent said graduation plate, graduations thereon corresponding to the exchange ratios between the currencies of various countries, said graduations radiating in concentric circles from the center or said indicator plate means and alternating between first normal upright standing graduations and second inverted graduations in every other concentric circle of graduations; and said graduation plate further has therethrough first sectoral cut-out window portions corresponding to said first alternating concentric graduations on said indicator plate means and second sectoral cut-out window portions therethrough corresponding to said second alternating concentric graduations on said indicator plate means.

5. A currency exchange device as claimed in claim 4 wherein said graduation plate is removable from said indicator plate means.

6. A currency exchange device as claimed in claim 1 wherein said indicator plate means is a folio surrounding said graduation plate with said eyelet means fitted through said folio and said graduation plate.

7. A currency exchange device as claimed in claim 1 wherein said indicator plate means is removable from said graduation plate and said eyelet means.

* * * * *